United States Patent [19]

Harris

[11] Patent Number: 4,597,258

[45] Date of Patent: Jul. 1, 1986

[54] COMBUSTOR MOUNT

[75] Inventor: Harold S. Harris, Glastonbury, Conn.

[73] Assignee: United Technologies Corporation, Hartford, Conn.

[21] Appl. No.: 675,091

[22] Filed: Nov. 26, 1984

[51] Int. Cl.[4] ..... F02C 7/20

[52] U.S. Cl. ..... 60/39.31; 60/39.36; 60/752

[58] Field of Search ..... 60/39.31, 39.32, 39.36, 60/39.37, 752, 755, 757, 759

[56] References Cited

U.S. PATENT DOCUMENTS 3,119,234 1/1964 Murray et al. ..... 60/39.37
3,500,639 3/1970 Stamm ..... 60/39.32

FOREIGN PATENT DOCUMENTS 2465080 3/1981 France ..... 60/752
2020370 11/1979 United Kingdom ..... 60/752

*Primary Examiner*—Louis J. Casaregola
*Attorney, Agent, or Firm*—Norman Friedland

[57] ABSTRACT

A mount for an annular burner for a gas turbine engine includes a pin attached to the engine case fitting through a hole in the lug extending from the burner, a bushing frictionally fitted to the pin with a flange bearing against the surface of the lug and a washer overlying the flange and bearing against the opposite surface of the lug. The washer and lug are fabricated from a nickel base alloy and the bushing is fabricated from a cobalt base alloy. The bushing is undercut adjacent the washer to reduce the wall thickness and allow for thermal expansion when the washer is tack welded to the lug.

5 Claims, 2 Drawing Figures

Figures 1, 2:
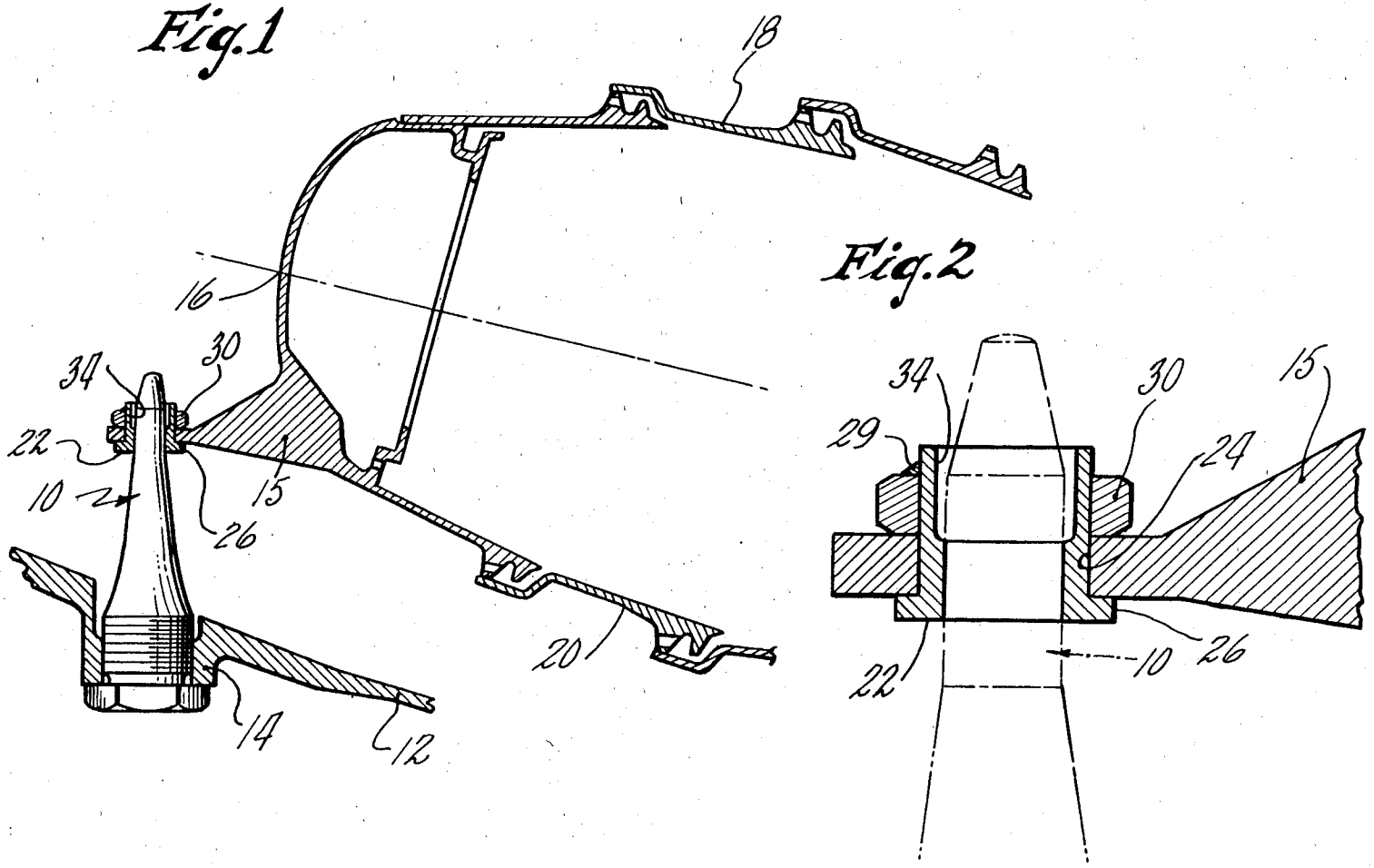

15
24
26
30
10
34
29
22
18
20
12
14
16

COMBUSTOR MOUNT

DESCRIPTION

1. Technical Field

This invention relates to gas turbine engines and particularly to attachment means for the engine's combustor.

2. Background Art

As is well known, the annular combustor of the gas turbine engine is fabricated into an annular passageway by a pair of concencentrically mounted liners (inner and outer) that surround the engine's shaft and are spaced from the engine casing. Each liner is generally cylindrically shaped and the liners are joined together by a hood that encloses their front ends. Typically, a liner is primarily supported to the engine case by a plurality of pins attached to or made integral with the engine case and compliment a mount lug that extends from this hood. This type of combustor is exemplified by the engine models 9D and PW2037 manufactured by Pratt & Whitney Aircraft of United Technologies Corporation, the assignee of this patent application.

Heretofore, the material used for these component parts used for supporting the liners to the engine case was stellite (which is a cobolt base alloy) which is relatively expensive and considered to be a stratigic material thus susceptible of being difficult to obtain. A less espensive and more easily obtainable material that exhibits sufficient strength to withstand this hostile environment is a nickel base alloy known as INCO 718. However, as is well known, the extreme heating of this material that is occasioned by welding or brazing adversely affects its strength. Additionally, heat treatment after welding or brazing results in distortion of the matting parts which is a condition that is intolerable for this particular application.

DISCLOSURE OF INVENTION

To obivate the problems noted above I have found that it is possible to utilize the least expensive material by utilizing a bushing, judiciously designed to frictionally fit the mount pin having a flange on one end and a recess formed in the opposite end fabricated from a hard-faced material or stellite and a complimentary washer fabricated from a nickel base alloy of INCO 600 that together with this flange sandwiches the mount lug.

A feature of this invention is to reduce the cost of the material used in a combustor of a gas turbine engine by replacing the stellite fabricated components by a less costly material and secure the components with a judiciously designed coupling. The coupling includes a bushing having a flange at one end force-fitted into a mount pin and extending through an aperture for receiving a washer that is subsequently welded to the shank of the bushing. The bushing is recessed in proximity to the weld for accommodating shrinkage occasioned in the welding operation. The bushing may be fabricated from stellite material or a hard-faced material that meets the heat and structural requirements, and the washer is fabricated from INCO 600 or other material that meets the high temperature requirements. The design obviates the heat treat process that was used in heretofore configurations.

Other features and advantages will be apparent from the specification and claims and from the accompanying drawings which illustrate an embodiment of the invention.

BRIEF DESCRIPTION OF DRAWING(S)

FIG. 1 is a partial view partly in schematic and partly in section showing the liner supportive to the engine's case, and FIG. 2 is a partial enlarged view in section and phantom showing the details of this invention.

BEST MODE FOR CARRYING OUT THE INVENTION

While in its preferred embodiment this invention is utilized to secure the annular burner of a gas turbine engine of the type manufactured by Pratt & Whitney Aircraft of United Technologies Corporation and for example has been utilized in the PW2037 engine, it is to be understood that the invention has utility for other types of engines. As can be seen in FIGS. 1 and 2, the mount pin 10 is secured to the engine casing 12 at the boss 14 by suitable threading arrangement. The mount lug 15 which may be fabricated from a nickel base alloy such as Inco 718 is integral with the hood 16 of the combustor liners (inner and outer) 18 and 20. In accordance with this invention the bushing 22 which may be fabricated from a cobalt base alloy such as stellite is force-fitted or frictionally retained onto the end of mount pin 10 and extends through opening 24 formed in the mount lug 15. A flange 26 on the bushing 22 extends beyond the opening 24 and its inner face bears against the surface of mount lug 15. A washer 30 fabricated from a nickel base alloy such as Inco 600 fits over the mount pin 10 on the opposite side of the mount lug 15 and extends so that its inner surface bears against the surface of mount lug 15. The washer which is a looser fit than the bushing 22 may be tack welded into place as shown by weldment 29.

As noted from the sole FIGURE, the bushing 22 is recessed or undercast at 34 adjacent the washer 30 so that in the tack weld operation the heat is dissipated through the now thinner walls and prevents distortion of the bushing and the heretofore necessary refinishing operation is eliminated.

It should be understood that the invention is not limited to the particular embodiments shown and described herein, but that various changes and modifications may be made without departing from the spirit and scope of this novel concept as defined by the following claims.

I claim:

1. For a gas turbine engine, mounting means for attaching the annular burner to the engine case including a mount lug having a relatively flat surface extending from and secured to the annular burner, a mount pin attached to the engine case having one end extending through an opening in the flat surface of said mount lug, a bushing frictionally engaging said pin and extending through said opening, and having a flange surrounding said opening and bearing against one side of said flat surface, a washer fitted over said pin and bearing against the opposite side of said flat surface to sandwich with said flange said mount lug, and said bushing having an increased internal diameter portion adjacent said washer and weldment means securing said washer to said mount lug.

2. For a gas turbine engine as in claim 1 wherein the material of said bushing is a cobalt base alloy, the material of said mount lug is a nickel base alloy and the material of said washer is a nickel base alloy.

3. For a gas turbine engine as in claim 2 wherein said nickel base alloy of said mount lug is Inco 718 and said nickel base alloy of said washer is Inco 600.

4. For a gas turbine engine as in claim 3 wherein the material in said bushing is stellite.

5. For a gas turbine engine as in claim 3 wherein the material in said bushing has a hard face coating.

* * * * *

UNITED STATES PATENT AND TRADEMARK OFFICE

CERTIFICATE OF CORRECTION

PATENT NO. : 4,597,258

DATED : July 1, 1986

INVENTOR(S) : Harold S. Harris

It is certified that error appears in the above-identified patent and that said Letters Patent is hereby corrected as shown below:

Column 1, line 12, change "concencentrically" to -- concentrically --

Column 1, line 15, after "shaped and" delete "the liners"

Column 1, line 16, after "encloses" change "their" to -- the --

Column 1, line 27, change "stratigic" to -- strategic --

Signed and Sealed this

Seventh Day of April, 1987

*Attest:*

DONALD J. QUIGG

*Attesting Officer*

*Commissioner of Patents and Trademarks*